US010762879B2

(12) United States Patent
Liu et al.

(10) Patent No.: US 10,762,879 B2
(45) Date of Patent: Sep. 1, 2020

(54) PIANO SYSTEM AND METHOD THEREOF

(71) Applicant: SUNLAND INFORMATION TECHNOLOGY CO., LTD., Shanghai (CN)

(72) Inventors: Xiaolu Liu, Shanghai (CN); Zhengchun Li, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/444,029

(22) Filed: Jun. 18, 2019

(65) Prior Publication Data

US 2019/0304413 A1 Oct. 3, 2019

Related U.S. Application Data

(63) Continuation of application No. PCT/CN2017/071222, filed on Jan. 16, 2017.

(51) Int. Cl.
*G10C 5/10* (2019.01)
*G10C 3/166* (2019.01)
(Continued)

(52) U.S. Cl.
CPC ..... *G10C 5/10* (2019.01); *G10C 3/00* (2013.01); *G10C 3/166* (2013.01); *G10C 3/26* (2013.01);
(Continued)

(58) Field of Classification Search
CPC ..... G10C 5/10
See application file for complete search history.

(56) References Cited

U.S. PATENT DOCUMENTS 5,231,283 A * 7/1993 Starkey ..... G01V 8/12 250/229
5,600,077 A * 2/1997 Honda ..... G10C 5/10 84/216
(Continued)

FOREIGN PATENT DOCUMENTS

CN 101114445 A 1/2008
CN 201638541 U 11/2010
(Continued)

OTHER PUBLICATIONS

International Search Report in PCT/CN2017/071222 dated Oct. 29, 2017, 5 pages.
(Continued)

*Primary Examiner* — Robert W Horn
(74) *Attorney, Agent, or Firm* — Metis IP LLC

(57) ABSTRACT

Aspects of the disclosure provide for mechanisms for providing muting functions for a piano system. In some embodiments, a piano system according to the disclosure includes a plurality of linkage structures coupled to a plurality of keys, a plurality of strings corresponding to the plurality of linkage structures, and a muting unit configured to place at least one elastic structure at a first position to implement a first mode for the piano system. In some embodiments, the first position is located between the linkage structures and the strings. In the first mode, the elastic structure may be placed at the first position to prevent an interaction between at least one of the linkage structures and the strings when one of the plurality of keys is depressed.

20 Claims, 12 Drawing Sheets

(51) Int. Cl.

| | |
|---|---|
| ***G10H 1/34*** | (2006.01) |
| ***G10C 3/00*** | (2019.01) |
| ***G10C 3/26*** | (2019.01) |
| *G10C 3/22* | (2019.01) |

(52) U.S. Cl.
CPC ..... *G10H 1/344* (2013.01); *G10C 3/22* (2013.01); *G10H 2230/011* (2013.01)

(56) References Cited

U.S. PATENT DOCUMENTS

| | | | | |
|---|---|---|---|---|
| 5,741,995 | A * | 4/1998 | Kawamura | G10H 1/0066 84/721 |
| 5,949,013 | A * | 9/1999 | Satoshi | G10C 5/10 84/719 |
| 6,194,649 | B1 * | 2/2001 | Itou | G10H 1/344 84/719 |
| 6,265,647 | B1 * | 7/2001 | Tamaki | G10C 5/10 84/216 |
| 6,362,412 | B1 * | 3/2002 | Ura | G10H 1/344 73/488 |
| 6,423,889 | B2 * | 7/2002 | Inoue | G10C 3/22 84/236 |
| 6,452,079 | B2 * | 9/2002 | Sugiyama | G10C 5/10 84/423 R |
| 6,683,242 | B2 * | 1/2004 | Inoue | G10C 5/10 84/719 |
| 7,094,961 | B2 * | 8/2006 | Ura | G10F 1/02 714/30 |
| 7,825,312 | B2 * | 11/2010 | Jones | G10C 5/10 84/243 |
| 7,973,233 | B2 * | 7/2011 | Honda | G10F 1/02 84/724 |
| 8,148,620 | B2 * | 4/2012 | Jones | G10C 5/10 84/423 R |
| 8,541,673 | B2 * | 9/2013 | Jones | G10C 5/10 84/243 |
| 9,336,765 | B2 * | 5/2016 | Ishii | G10H 3/18 |
| 9,384,715 | B2 * | 7/2016 | Taniguchi | G10C 3/18 |
| 9,899,014 | B2 * | 2/2018 | Nishimura | G10H 1/346 |
| 2002/0121183 | A1 | 9/2002 | Inoue et al. | |
| 2019/0304413 | A1 * | 10/2019 | Liu | G10C 3/00 |

FOREIGN PATENT DOCUMENTS

| | | |
|---|---|---|
| CN | 202798012 U | 3/2013 |
| WO | 2013080370 A1 | 6/2013 |

OTHER PUBLICATIONS

Written Opinion in PCT/CN2017/071222 dated Oct. 25, 2017, 4 pages.

* cited by examiner

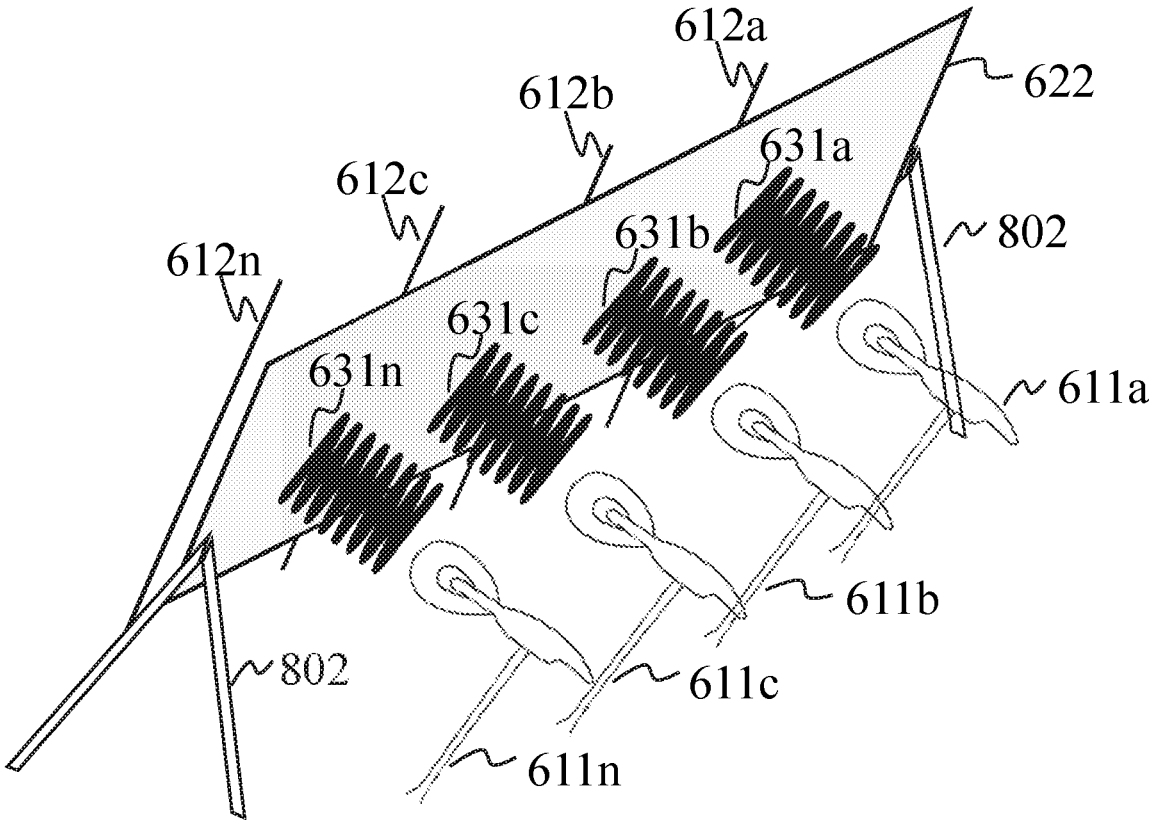
FIG. 8-A

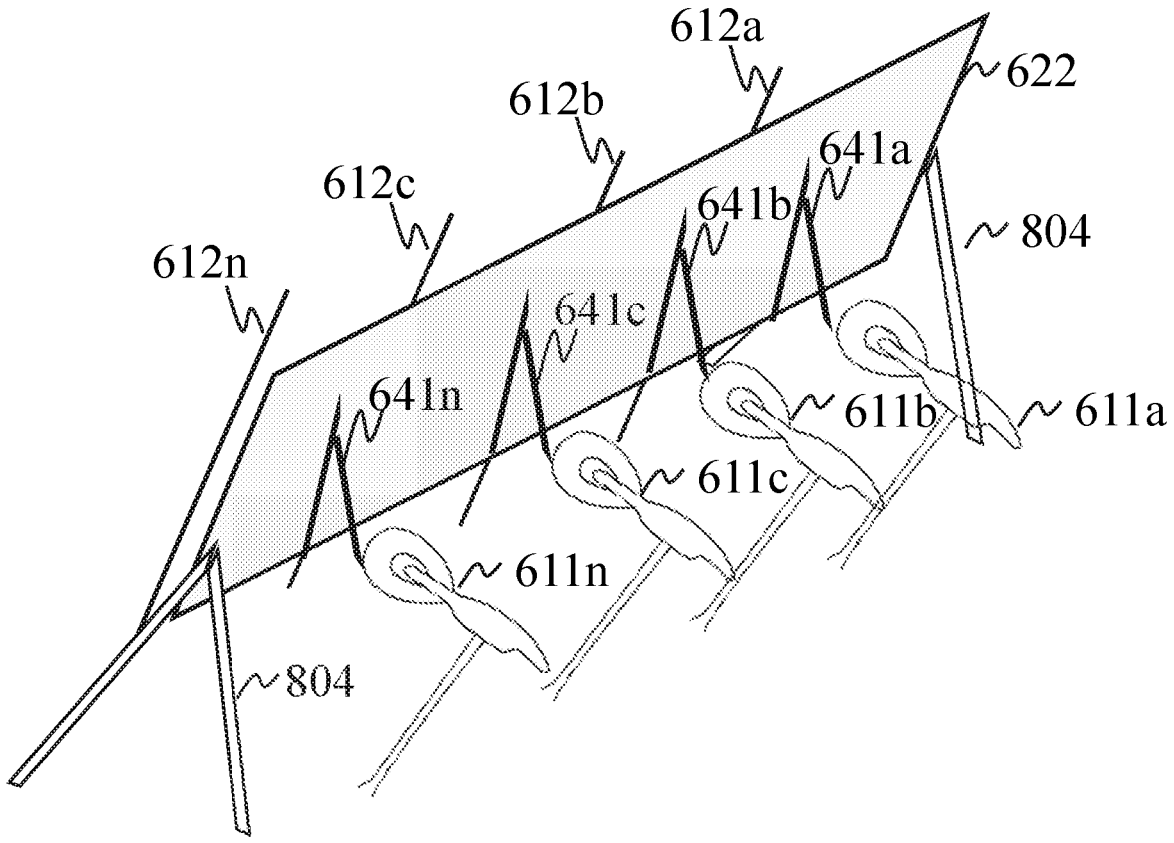
FIG. 8-B

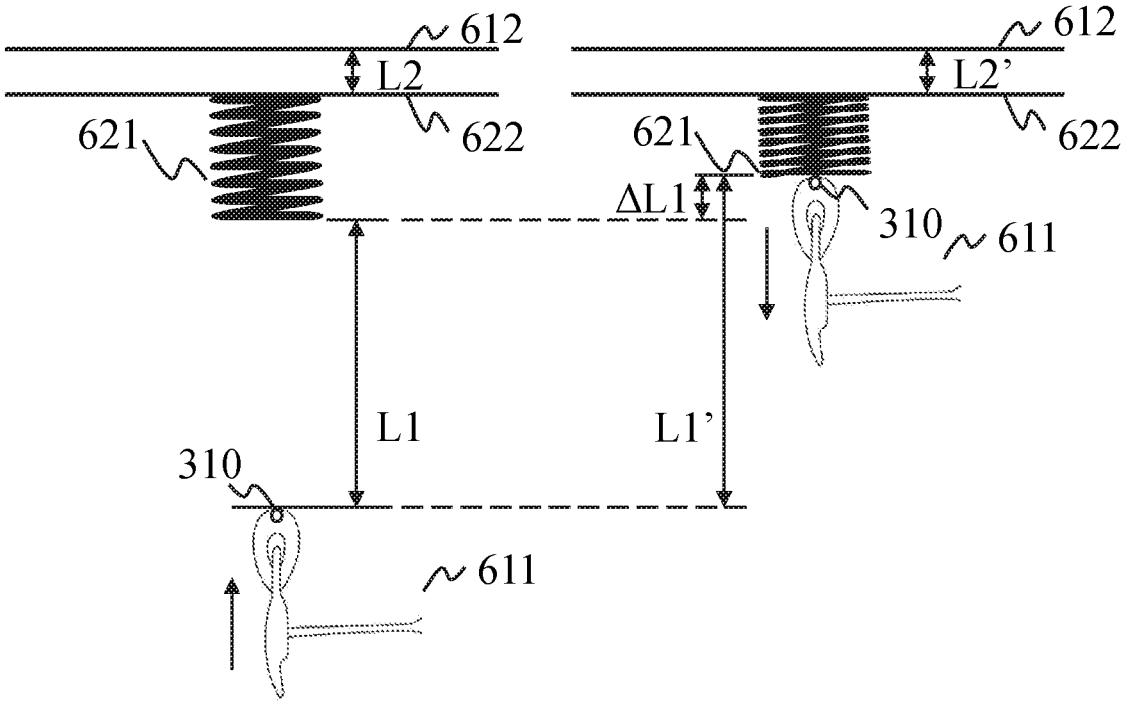
FIG. 9-A
FIG. 9-B

PIANO SYSTEM AND METHOD THEREOF

CROSS-REFERENCE TO RELATED APPLICATIONS

This present application is a continuation of International Application No. PCT/CN2017/071222, filed on Jan. 16, 2017, the entire contents of which are hereby incorporated by reference.

TECHNICAL FIELD

The present disclosure generally relates to a piano system, and more particularly, to a piano system with muting functions.

BACKGROUND

As one of the world's most popular musical instruments, the piano is widely played and studied today. Piano playing may offer educational and wellness benefits to a pianist. However, one man's music may be another man's noise. It is desirable to provide muting functions to a piano.

SUMMARY

According to an aspect of the present disclosure, a piano system may include multiple linkage structures coupled to multiple keys, multiple strings corresponding to the linkage structures, and a muting unit configured to place at least one elastic structure at a first position to implement a first mode for the piano system.

In some embodiments, the first position is located between the linkage structures and the strings.

In some embodiments, the elastic structure may be placed at the first position to prevent an interaction between at least one of the linkage structures and the strings when one or more of the keys are depressed.

In some embodiments, the piano system may further include a switch configured to switch between the first mode and a second mode.

In some embodiments, the muting unit may be configured to place the at least one elastic structure at a second position for implementing the second mode, wherein the second position is not located between the linkage structures and the strings.

In some embodiments, the muting unit may further include a board configured to mount one or more elastic structures.

In some embodiments, the muting unit may be further configured to: place the board at the first position to implement the first mode, and place the board at the second position to implement the second mode.

In some embodiments, the board may be operationally coupled to an action mechanism for moving between the first position and the second position.

In some embodiments, the elastic structure may include at least one of a spring, an elastic strip, or an elastic buffer.

In some embodiments, the piano system may further include one or more sensors configured to record information relating to a first interaction between at least one of the linkage structures and the elastic structure in the first mode.

In some embodiments, the information may include at least one of pressure information, motion information, or compression information.

In some embodiments, the sensors may include at least one of a pressure sensor, a speed sensor, an accelerometer, or a mechanical sensor.

In some embodiments, the piano system may further include a processor configured to: generate one or more parameters based on the information, generate a plurality of characteristic values of a sound based on the plurality of parameters, and generate a sound control signal based on the plurality of characteristic values.

In some embodiments, the piano system may further include a peripheral device configured to generate a sound based on the sound control signal.

In some embodiments, the piano system may provide one or more muting functions in the first mode.

In some embodiments, the linkage structures may correspond to the strings to generate a sound in the second mode.

According to an aspect of the present disclosure, a method may include switching a piano system to a first mode, and providing at least one muting function to implement the first mode using a muting unit, wherein providing the muting function may include placing an elastic structure at a first position to prevent an interaction between a linkage structure and a string of the piano system when a key of the piano system is depressed, and wherein the first position may be located between the linkage structure and the string.

In some embodiments, the method may further include switching the piano system to a second mode, and placing the elastic structure at a second position to implement the second mode, wherein the second position may be not located between the linkage structure and the string.

In some embodiments, providing the muting function may further include placing a board mounting the elastic structure at the first position.

In some embodiments, the method may further include recording information relating to a first interaction between the linkage structure and the elastic structure in the first mode.

In some embodiments, the method may further include generating multiple parameters based on the information, generating multiple characteristic values of a sound based on the parameters, and generating a sound control signal based on the characteristic values.

In some embodiments, the method may further include generating a sound in a peripheral device of the piano system based on the sound control signal.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIGS. 8-A and 8-B illustrate examples of acoustic component and muting unit implementing the silent mode according to some embodiments of the present disclosure;

FIGS. 9-A and 9-B are diagrams illustrating mechanisms for implementing an exemplary acoustic component in the silent mode according to some embodiments of the present disclosure;

DETAILED DESCRIPTION

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirits and scope of the present disclosure. Thus, the present disclosure is not limited to the embodiments shown, but to be accorded the widest scope consistent with the claims.

It will be understood that the term "system," "unit," "module," and/or "block" used herein are one method to distinguish different components, elements, parts, section or assembly of different level in ascending order. However, the terms may be displaced by other expression if they may achieve the same purpose.

It will be understood that when a unit, module or block is referred to as being "on," "connected to" or "coupled to" another unit, module, or block, it may be directly on, connected or coupled to the other unit, module, or block, or intervening unit, module, or block may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

The terms "user" and "player" may be interchangeable throughout the present disclosure, referring to any human being, robot, or any other machine capable of playing the piano. The terms "music" and "sound" may be interchangeable.

Figure 1:
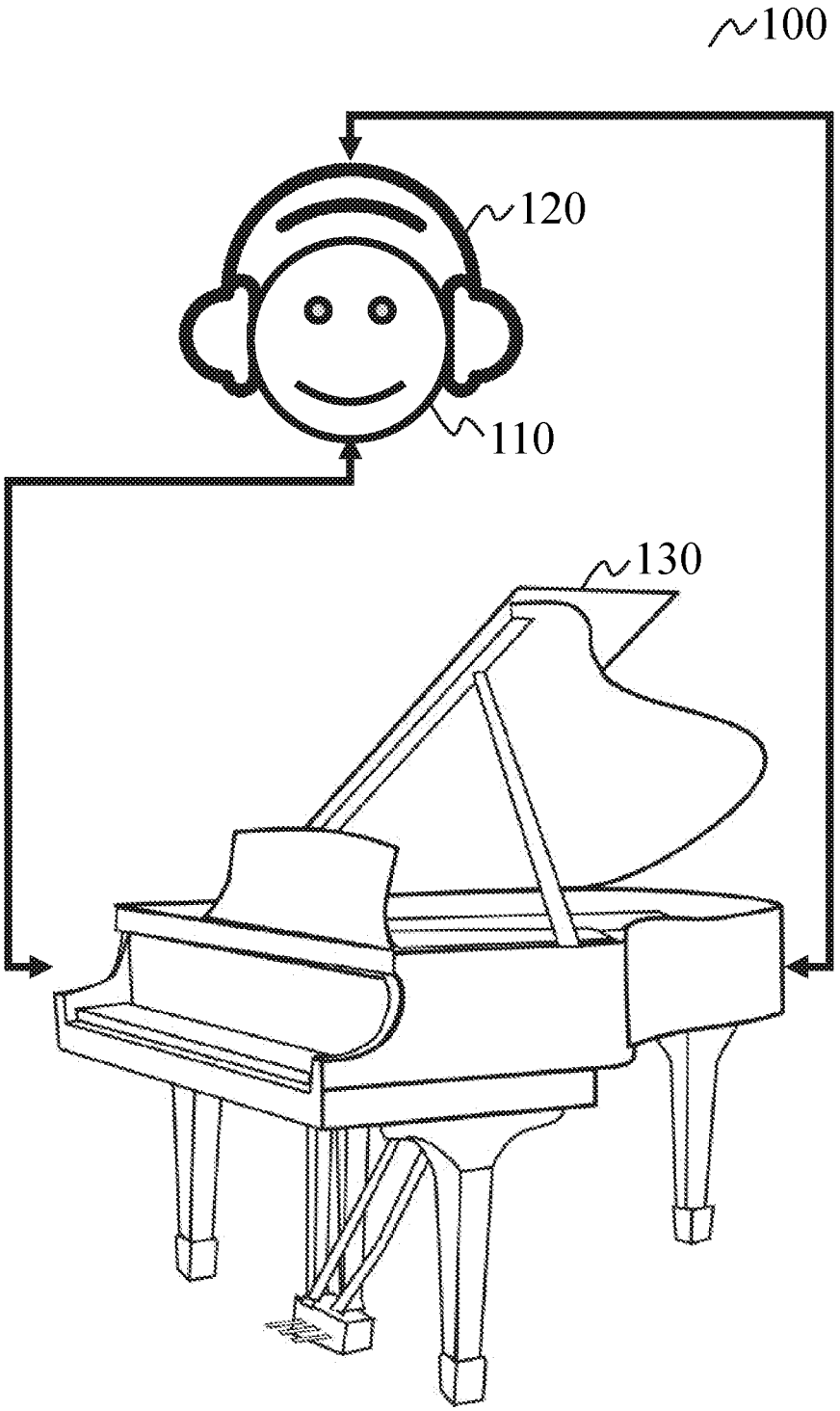
FIG. 1 is a block diagram illustrating an application scenario of a piano system according to some embodiments of the present disclosure.

FIG. 1 is a block diagram illustrating an application scenario of a piano system 100 according to some embodiments of the present disclosure. It should be noted that the piano system 100 described below is merely provided for illustrative purposes, and not intended to limit the scope of the present disclosure.

As illustrated in FIG. 1, the piano system 100 may include one or more peripheral devices 120, a piano 130, and/or any other suitable component to implement various functions described in the present disclosure.

The piano system 100 may be and/or include a musical instrument with a keyboard (e.g., a piano, an organ, an accordion, a synthesizer, an electronic keyboard, etc.), a string musical instrument (e.g., a guitar, a zither, a koto, etc.), or the like, or any combination thereof. For example, the piano system 100 may include a piano 130 with one or more keys and/or pedals. In some embodiments, the piano system 100 may generate sounds when a user 110 plays piano 130. Alternatively or additionally, the piano system 100 can automatically generate sounds and/or audio content for playback. In some embodiments, the piano system 100 may implement one or more muting functions. For example, the volume of sounds generated by the piano system 100 may be adjusted, reduced, etc. during a user's performance. As another example, the sounds can be muted. The piano system 100 can obtain information about the performance (also referred to herein as "performance information") and can generate audio content based on the performance information. The performance information may include, for example, information about one or more piano keys that are pressed, timing information about one or more piano keys (e.g., a time instant corresponding to depression of one or more piano keys by a user, a time instant corresponding to release of one or more piano keys, a duration of the depression, etc.), the pressure applied to one or more piano keys by a user, one or more operation sequences of piano keys, timing information about a user's application of one or more pedals of a piano, one or more musical notes produced during the performance, etc. In some embodiments, playback of the audio content can be provided by peripheral device 120. As referred to herein, a piano may be an acoustic piano, an electric piano, an electronic piano, a digital piano, and/or any other musical instrument with a keyboard. In some embodiments, the piano may be a grand piano, an upright piano, a square piano, etc.

In some embodiments, the piano system 100 may have one or more working modes, such as a normal mode, a silent mode, a headset mode, or the like, or a combination thereof. In some embodiments, in the normal mode, the piano system 100 can produce piano sounds without providing one or more muting functions. In some embodiments, in the silent mode, the piano system 100 can provide one or more muting functions. For example, the piano system 100 can reduce the volume of the sounds produced by a piano of the piano system 100. More particularly, for example, the sounds produced by the piano in the silent mode may be quieter than those produced in the normal mode. As another example, the piano system 100 can mute the piano (e.g., by preventing interactions between linkage structures and strings of the piano). In some embodiments, in the headset mode, the piano system 100 can generate media content (e.g., video content, audio content, graphics, etc.) based on a user's performance of the piano and can provide playback of the media content.

The piano system 100 may implement multiple working modes and can switch between the working modes based on user selections. For example, the piano system 100 can prompt user 110 to select one or more of the working modes (e.g., by providing a switch, presenting one or more user interfaces, etc.). In response to receiving a user selection of one or more working modes (e.g., via a switch), the piano system 100 can implement the selected working mode(s). In some embodiments, the piano system 100 can implement multiple working modes (e.g., the headset mode and the silent mode) simultaneously.

In some embodiments, the user 110 may be a human user, a robot, a computing device, or any other user that is capable of operating the piano system 100. The user 110 may depress or release one or more keys and/or pedals of the piano system 100 using one or more parts of the user's body when playing. For example, the user 110 may depress or release one or more keys in the piano system 100 to play music by fingers. The user 100 may depress or release one or more pedals of the piano system 100 to play music by one or both feet.

In some embodiments, the peripheral device 120 may receive a sound control signal from the piano system 100. The peripheral device 120 may generate and/or play a sound according to the received sound control signal. In some embodiments, the peripheral device 120 may facilitate the user 110 to enjoy the sound/music during the playing of the piano system 100. In some embodiments, the peripheral device 120 may include one or more input devices and/or output devices, or the like. For example, the input device may include, a microphone, a camera, a keyboard (e.g., a computer keyboard), a touch-sensitive device, or the like, or any combination thereof. The output device may include, an audio player, an earphone, a stereo, loudspeaker, headphone, headset, or the like, or any combination thereof.

Figure 2:
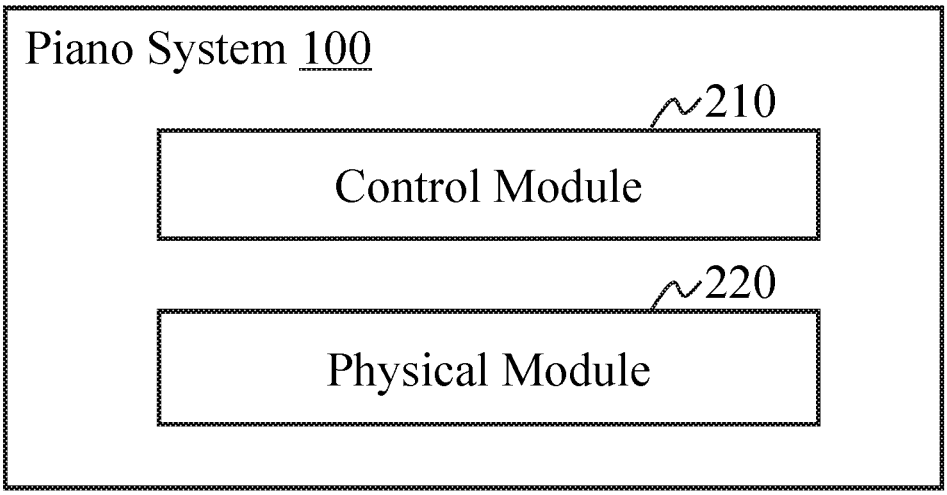
FIG. 2 is a block diagram illustrating an exemplary piano system according to some embodiments of the present disclosure.

FIG. 2 is a block diagram illustrating an exemplary piano system 100 according to some embodiments of the present disclosure. In some embodiments, the piano system 100 may include a control module 210 and a physical module 220.

The control module 210 may control the piano system 100. Controlling herein may include switching the physical module 220 between different working modes, processing information relating to signals generated within the piano system 100, generating a sound and/or audio content, recording the sound and/or storing the audio content, storing information relating to the piano system 100, or the like, or a combination thereof. In some embodiments, the signal generated within the piano system 100 may include information about one or more interactions between one or more components inside and/or outside the piano system 100 on other component(s) inside the piano system 100. The interactions may include one or more physical interactions, such as compression, extrusion, rebound, or the like, or a combination thereof. In some embodiments, the control module 210 can include one or more units as described in connection with FIGS. 3 and 4 below.

The physical module 220 may generate a sound in the piano system 100. In some embodiments, the physical module 210 may include one or more piano actions, muting units, keyboards, pedals, protective cases, soundboards, strings, or the like, or a combination thereof. For example, each of the piano actions may include, one or more keys, wippens, repetition levers, jacks, linkage structures, strings, dampers, or the like, or a combination thereof. A linkage structure may include one or more mechanic mechanisms that can sense motion of one or more keys of the piano system 100 and/or translate the motion of the key(s) into motion of one or more other components of the piano system 100. In pianos with acoustic strings, the linkage structure may impact the string(s) to generate a sound. The linkage structure may be in direct or indirect contact with the key(s). At rest, the linkage structure does not have to be in contact with the string(s). The linkage structure may receive a depression of the key(s) by a user through the wippen(s). The linkage structure may move towards one or more strings after it receives the depression of the key(s). The linkage structure in a digital piano may simulate the touch and feel of an acoustic piano. The linage structure may include one or more hammers (e.g., as in acoustic pianos), weighted keys (e.g., as in digital pianos), hammer actions (e.g., as in digital pianos), etc. The linage structure may have one or more parts. The one or more parts may be connected through shaft(s), spring(s), gear(s), rail(s), screw(s), etc. Each part may be made of various materials. The various materials may include wood, plastics, metals, alloys, ceramics, etc. In some embodiments, the physical module 220 can include one or more units as described in connection with FIGS. 5 and 7 below. In some embodiments, the physical module 220 may include an elastic structure to lower or mute the sounds generated in the piano system 100.

Figure 3:
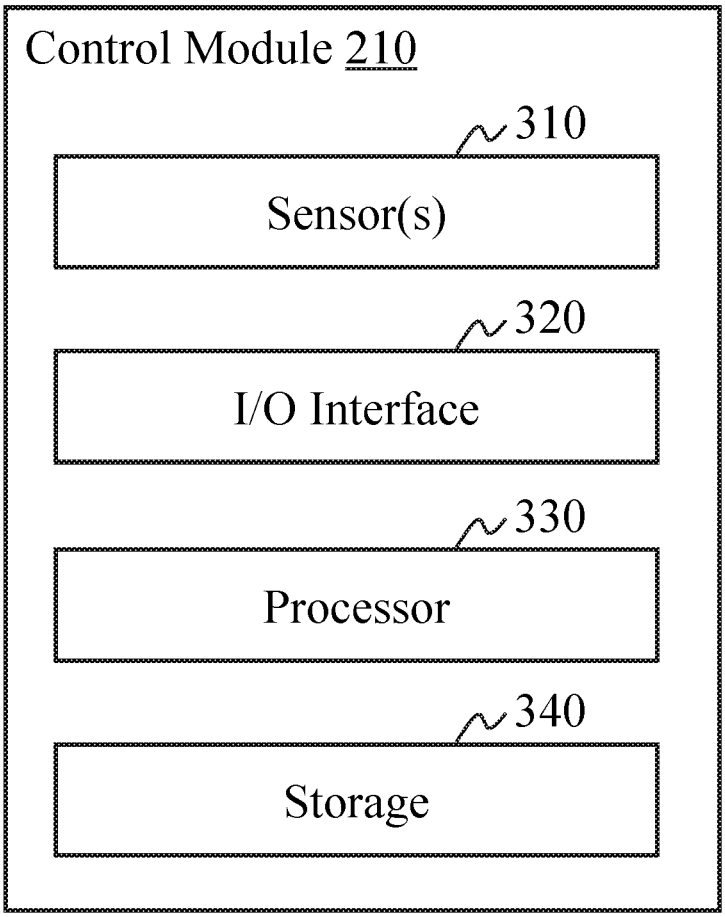
FIG. 3 is a block diagram illustrating an exemplary control module according to some embodiments of the present disclosure.

FIG. 3 is a block diagram illustrating an exemplary control module 210 according to some embodiments of the present disclosure. The control module 210 may include one or more sensors 310, an I/O interface 320, a processor 330, and a storage 340.

In some embodiments, the sensor(s) 310 may detect, receive, process, record, etc. information relating to interactions between components of the piano system 100. The interactions may include, for example, an interaction between a linkage structure and an elastic structure, an interaction between a linkage structure and one or more strings, etc. As referred to herein, an interaction between a first component and a second component of the piano system 100 may include any contact between the first component and the second component. The contact may be direct or indirect. The contact may last for any period of time. Information about such interaction may include any information about the first component, the second component, and/or any other component of the piano system 100 before, during, and/or after the interaction. The information may include, for example, pressure data, motion data, compression data, etc. In some embodiments, the pressure data may include any data and/or information relating to a force applied to a first component of the piano system 100 by one or more other components of the piano system 100 (e.g., a second component of the piano system 100). For example, the pressure data may include data and/or information about a pressure applied to one or more strings by a linkage structure, a pressure applied to an elastic structure by a linkage structure, a pressure applied to a key pressed by a user, etc. The pressure data may include, for example, an area over which the pressure acts, a value of the pressure, a duration of the pressure, a direction of the pressure, an amount of a force related to the pressure, etc. The motion data can include any information and/or data about movement of one or more linkage structures, strings, elastic structures, and/or any other component of the piano system 100. For example, the motion data can include a speed and/or velocity of a linkage structure related to the interaction (e.g., a speed at which the linkage structure strikes a string), a velocity of one or more points of a string during an interaction between the string and a linkage structure, etc. As another example, the motion data can include an acceleration of the linkage structure during the interaction, an acceleration of the elastic structure, etc. The compression data may include data and/or information about the elastic structure when the elastic structure is compressed or stretched. For example, the compression data can include a compressed length, area, or volume of the elastic structure, etc. In some embodiments, the sensor(s) 310 may record an amount of pressure applied to a string when a linkage structure strikes the string. In some embodiments, the sensor(s) 310 may be and/or include a pressure sensor, a speed sensor, an accelerometer, a mechanical sensor, or the like, or any combination thereof. In some embodiments, the sensor(s) 310 may be coupled with one or more keys, linkage structures, strings, and/or any other component of the piano system 100.

In some embodiments, the I/O interface 320 may provide one or more interfaces to facilitate communications between the piano system 100 and a user 110, an external device, or a peripheral device 120. The I/O interface 320 may provide a sound signal, a condition of the piano system 100, a current status of the piano system 100, and/or a menu for the user 110. Thus, the user 110 may select certain working modes/functions/features of the piano system 100, and the I/O interface 320 may receive the selection of the user 110. In some embodiments, the I/O interface 320 may facilitate the piano system 100 to receive an input provided by the user 110. The input may be an image, a sound/voice, a gesture, a touch, a biometric input, etc.

In some embodiments, the I/O interface 320 may provide one or more interfaces for the peripheral device 120 to be connected with the piano system 100. In some embodiments, the peripheral device 120 may include an input device and/or output device, or the like. For example, the input device may include a microphone, a camera, a keyboard (e.g., a computer keyboard), a touch-sensitive device, or the like. The output device may include, a display, a stereo, a loudspeaker, a headset, an earphone, or the like. In some embodiments, the loudspeaker and/or headset may be used for playing a sound generated by the piano system 100.

In some embodiments, the processor 330 may process the information transmitted from the sensor 310 and/or I/O interface 320. The processing may include calculation of the pressure to generate parameters relating to a sound, comparison of parameters with one or more reference values, generation of a sound based on parameters, smoothing of the sound, conducting a judgment according to the input, or the like, or a combination thereof. In some embodiments, the processor 330 may process the pressure information (e.g., values of pressure at different locations and/or at different times, etc.) to generate one or more parameters. Further, the processor 320 may translate the parameters into a sound control signal indicative of a sound. In some embodiments, the processed information (e.g., sound control signal) may be sent to the I/O interface 320 and/or the storage 340. In some embodiments, the processor 330 may include a microcontroller, a reduced instruction set computer (RISC), application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an acorn reduced instruction set computing (RISC) machine (ARM), or any other suitable circuit or processor capable of executing computer program instructions, or the like, or any combination thereof.

In some embodiments, the storage 340 may store information associated with the piano system 100. The information may include the user profile, computer program instructions, presets, system parameters, parameters relating to a sound, information relating to interactions between components of the piano system 100, etc. In some embodiments, the user profile may relate to the proficiency, preferences, characteristics, music genre, favorite music, and/or favorite composers of a human user. In some embodiments, the computer program instructions may relate to working modes, volume control, spatial positions of the components inside the piano system 100, pressure, mapping rules (e.g., from a pressure to a sound), distance adjustment, or the like, or a combination thereof. The distance adjustment may further include position adjustment of a board 622 shown in FIG. 6. In some embodiments, the presets may relate to the working modes, functions, menus of the piano system 100. The presets may be set by the piano manufacturer or the user/player. In some embodiments, the system parameters may relate to the characteristics, specifications, features of the physical module 220 and/or control module 210. In some embodiments, the information relating to the interactions may include the pressure data relating to a depression of a key, a strike of a linkage structure on a string, the speed of the linkage structure, the acceleration of the linkage structure, or the like, or a combination thereof. The information may be collected by the sensor 310 (e.g., a pressure sensor, a speed sensor, an accelerometer, or a mechanical sensor).

In some embodiments, storage 340 may store information received from the user 110, the Internet, the physical module 220, the sensor 310 and the processor 330, via the I/O interface 320. Furthermore, the storage 340 may communicate with other modules or units in piano system 100.

In some embodiments, the storage 340 may include one or more storage media such as magnetic or optical media. The storage media may include disk (fixed or removable), tape, CD-ROM, DVD-ROM, CD-R, CD-RW, DVD-R, DVD-RW, Blu-Ray, etc. In some embodiments, the storage 340 may include volatile or non-volatile memory media such as RAM (e.g., synchronous dynamic RAM (SDRAM), double data rate (DDR, DDR2, DDR3, etc.) SDRAM, low-power DDR (LPDDR2, etc.) SDRAM, Rambus DRAM (RDRAM), static RAM (SRAM)), ROM, nonvolatile memory (e.g. flash memory) accessible via a peripheral interface such as a USB interface, etc.

Figure 4:
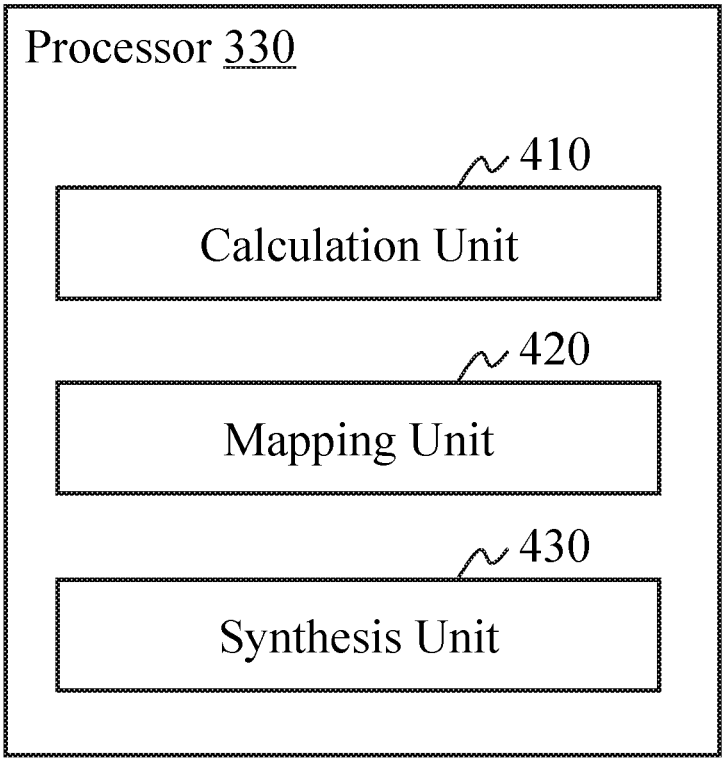
FIG. 4 is a block diagram illustrating an exemplary processor according to some embodiments of the present disclosure.

FIG. 4 is a block diagram illustrating an exemplary processor 330 according to some embodiments of the present disclosure. As shown in FIG. 4, the processor 330 may include a calculation unit 410, a mapping unit 420, and a synthesis unit 430.

In some embodiments, the calculation unit 410 may process information relating to interactions between components of the piano system 100. In some embodiments, the calculation unit 410 may further generate one or more parameters relating to a sound based on the information. In some embodiments, the pressure data in accordance with the current pressure may be processed according to certain algorithm to generate one or more parameters (e.g. the maximal value of the pressure, the minimal value of the pressure, the variation of the pressure over time, the duration of the pressure, the frequency of the pressure variation, the total impulse of the pressure during a certain period, etc.). In some embodiments, the parameters may be sent to mapping unit 420 for further processing.

In some embodiments, the mapping unit 420 may convert the parameters into one or more characteristic values relating to a sound. Each of the characteristic values may include any value related to a sound, such as a frequency of the sound (e.g., a music tone), an amplitude (e.g., a volume of the sound), a duration of the sound, a pitch of the sound, or the like, or any combination thereof.

In some embodiments, conversion between the parameters and the characteristic values can be made based on one or more mapping rules. Each of the mapping rules may be and/or include one or more computer executable rules. Each of the mapping rules can represent a relationship between one or more of the parameters and one or more characteristic values of a sound. In some embodiments, the relationship may be expressed as one or more functions, data sheets, executable instructions, etc. In some embodiments, the mapping unit 420 may convert the parameters based on the relationship between the parameters and the characteristic values. For example, the mapping unit 420 may determine the sound frequency based on the frequency of the pressure (e.g., the pressure of string(s) or an elastic structure struck by a linkage structure) variation. As another example, the mapping unit 420 may determine the duration of sound based on the duration of pressure. As still another example, the mapping unit 420 can determine the sound volume based on the total impulse of the pressure, etc.

In some embodiments, the synthesis unit 430 may generate a sound control signal based on one or more of the characteristic values provided by the mapping unit 420. The sound control signal may be and/or include a frequency waveform, a time-domain audio spectrum, an electricity waveform, a digital translation information, a pulse code modulation (PCM) of the sound, etc. In some embodiments, a specific music tone may correspond to a waveform with a specific frequency, a sound volume may correspond to the amplitude of a waveform. In some embodiments, the synthesis unit 430 may extract the music tone (and/or sound volume, etc.) from the characteristic values, and synthesis corresponding waveform(s). In some embodiments, the sound control signal may be expressed by one or more audio formats, for example, waveform audio file format (WAV), audio interchange file format (AIFF), adaptive transform acoustic coding (ATRAC), MP3, etc. The sound control signal may be used by the peripheral device 120, such as an audio player, a loudspeaker or a headset, to play a sound/music. For example, the peripheral device 120 (e.g., an audio player) may convert the sound control signal into audio content based on one or more algorithms, according to the audio format. As another example, the peripheral device 120 (e.g., a loudspeaker, a headset, etc.) may convert the audio content into sounds. In some embodiments, the synthesis unit 430 may transmit the sound control signal to the I/O interface 320. The peripheral device 120 may receive the sound control signal via the I/O interface 320. In some embodiments, the synthesis unit 430 may transmit the sound control signal to the storage 340 for storing.

Figure 5:
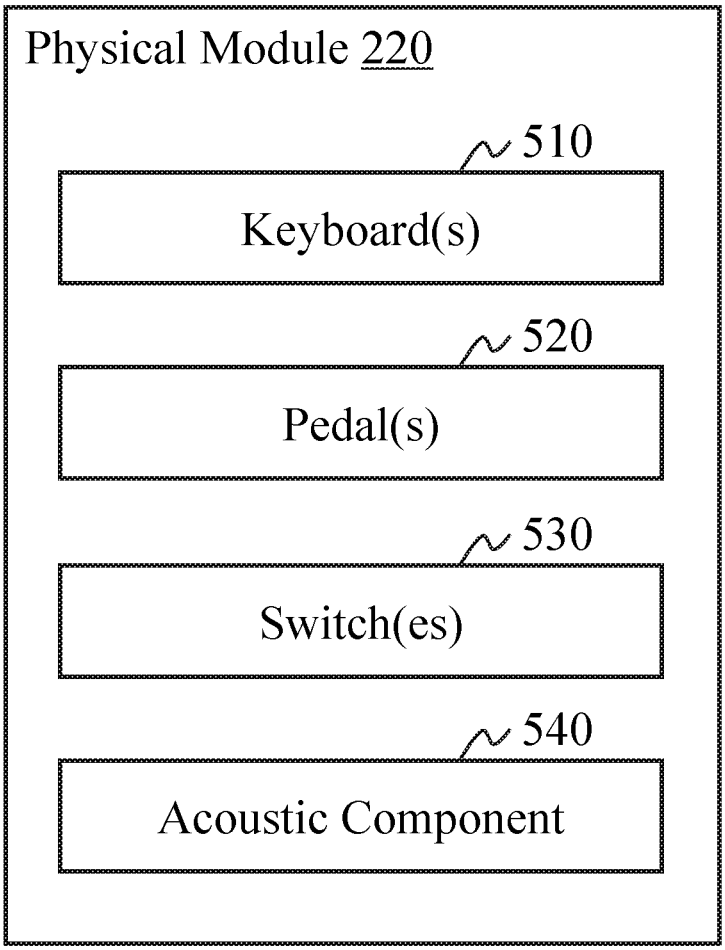
FIG. 5 is a block diagram illustrating an exemplary physical module according to some embodiments of the present disclosure.

FIG. 5 is a block diagram illustrating an exemplary physical module 220 according to some embodiments of the present disclosure. The physical module 220 can include any suitable component for generating sounds in the piano system 100. For example, the physical module 220 may include one or more keyboards 510, one or more pedals 520, one or more switches 530, an acoustic component 540, a housing (not shown in FIG. 5), soundboards (not shown), or the like, or any combination thereof.

Keyboard(s) 510 may include one or more keys (e.g., white keys, black keys, etc.). In some embodiments, each of the keys may correspond to a musical note.

Each of pedal(s) 520 may be or include a foot-operated lever that can modify the piano's sound. For example, pedal(s) 520 may include a soft pedal (e.g., a una corda pedal) that may be operated to cause the piano to produce a softer and more ethereal tone. As another example, pedal(s) 520 may include a sostenuto pedal that may be operated to sustain selected notes. As still another example, pedal(s) 520 may include a sustaining pedal (e.g., a damper pedal) that may be operated to make notes played continue to sound until the pedal is released. In some embodiments, each of pedal(s) 520 may be and/or include an input device that can receive user input entered by a user's foot, feet, etc. Pedal(s) 520 can receive the user input and cause one or more functions of the piano system 100 to be implemented based on the user input. For example, a user may select a working mode of the piano system 100 using one or more pedals 520. As another example, a muting function can be implemented in response to one or more operations of pedal(s) 520 by a user.

Pedal(s) 520 may be positioned in any suitable manner for user operation. For example, one or more of pedals 520 can be positioned below the keyboard 510 and can be operated by a user's foot and/or feet. Pedal(s) 520 may be configured to contact with one or more dampers and/or muting unit 620 (shown in FIG. 7). In some embodiments, the position of pedal 520 may be adjustable so that the sound generated by the acoustic component 540 may be tuned. In some embodiments, physical module 220 may include more than one pedal 520.

Switch(es) 530 may provide a user with one or more working modes of the piano system 100 and may include mechanisms for receiving a user selection of one or more of the working modes. For example, switch(es) 530 may be and/or include one or more buttons, knobs, pedals, and/or any other device that can be used to receive a user selection of one or more working modes. In some embodiments, the working modes may include, for example, listening mode (e.g., headset mode and/or public mode) and play mode (e.g. volume control mode and/or normal mode). In some embodiments, the switch(es) 530 may be operationally coupled to one or more components of physical module 220 and/or piano system 100 to control the components to implement one or more functions. For example, the switch(es) 530 may be electrically and/or mechanically coupled to one or more of the components. The switch(es) 530 may be operationally coupled to one or more of the components via a direct connection, one or more intermediate devices, and/or in any other manner. In some embodiments, switch(es) 530 may be operationally coupled to muting unit 620 to control the muting unit 620 to implement one or more muting functions (e.g., by controlling one or more portions of the muting unit 620 to move between/among different positions). For example, switch(es) 530 can be mechanically coupled to muting unit 620 (e.g., via a direct connection or any connection). In some embodiments, switch(es) 530 may contact with one or more portions of muting unit 620 (e.g., one or more components of muting unit 620 as illustrated in FIGS. 6-9B).

Acoustic component 540 may generate sounds in piano system 100. In some embodiments, the acoustic component 540 may be operationally coupled to the switch(es) 530, keyboard(s) 510, pedal(s) 520, and/or any other component of physical module 220 and/or piano system 100. For example, the acoustic component 540 may be mechanically coupled to one or more components of physical module 220 and/or piano system 100. In some embodiments, one or more portions of acoustic component 540 (e.g., one or more components of acoustic component 540 as described in connection with FIGS. 6-9B) may contact with the sensor(s) 310 in the control module 210.

In some embodiments, one or more of pedal(s) 520 and switch(s) 530 may be integrated on a single device. For example, operations of a pedal by a user may cause the piano system 100 to switch between different working modes (e.g., a normal mode, a silent mode, etc.).

Figure 6:
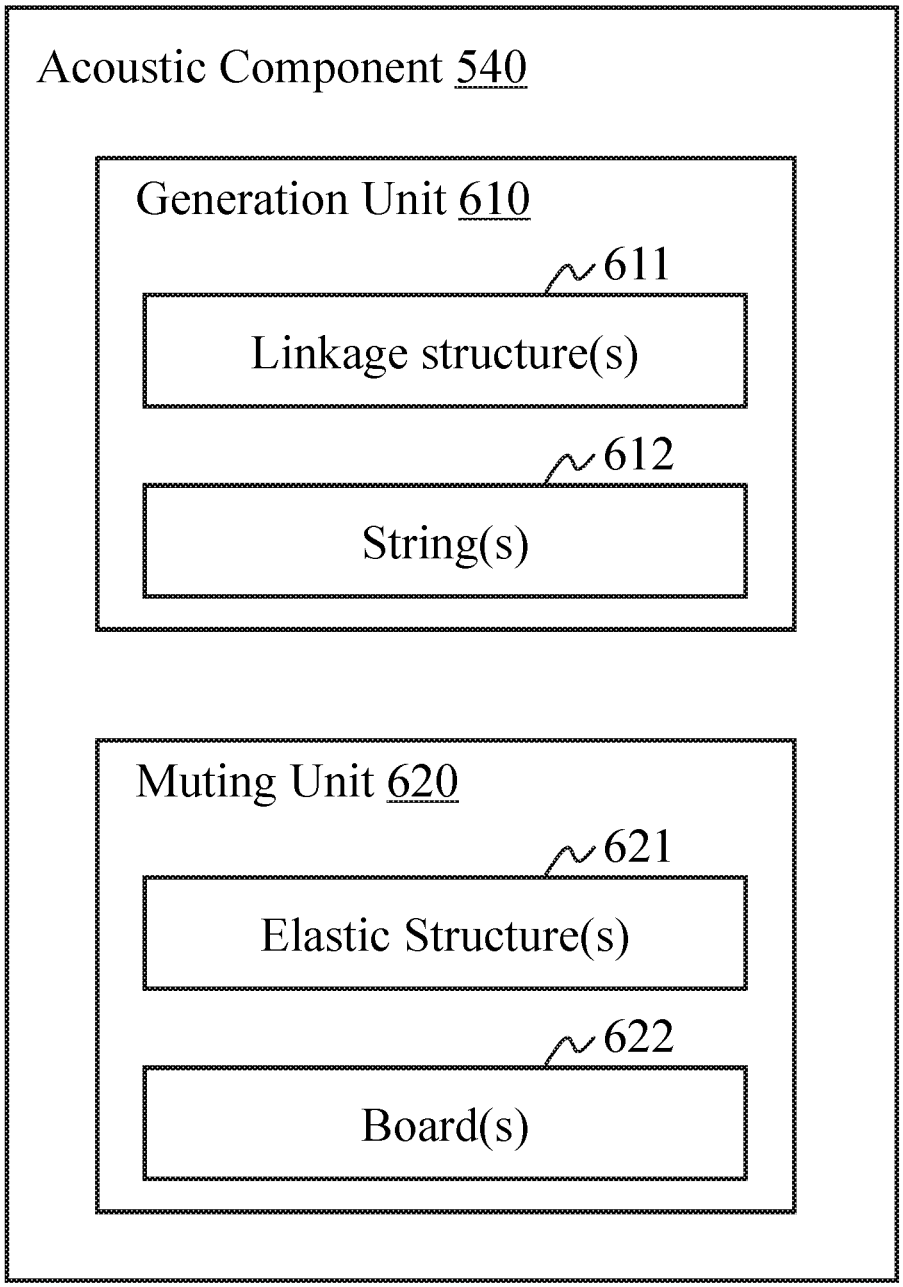
FIG. 6 is a diagram illustrating an exemplary acoustic component according to some embodiments of the present disclosure.

FIG. 6 is a diagram illustrating an exemplary acoustic component 540 according to some embodiments of the present disclosure. Acoustic component 540 may include a generation unit 610, a muting unit 620, and/or any other suitable component for producing sounds in the piano system 100.

In some embodiments, the generation unit 610 may generate sounds when user 110 plays a piano of the piano system 100. In some embodiments, generation unit 610 may include one or more linkage structures 611 and strings 612. A linkage structure 611 may include a link and a block. Block may be in connection with one end of link. Each linkage structure 611 may be associated with one or more keys of the piano. The other end of link of linkage structure 611 may be in connection with the one or more keys of the piano. A linkage structure 611 may be positioned at a resting position when its corresponding key is not depressed. When a user depresses the key, the linkage structure 611 may move towards the string 612 from the resting position. The linkage structure 611 may strike the string 612 at a speed (e.g., several meters per second). The string 612 may vibrate to generate a sound. As will be discussed in connection with FIGS. 8-A and 8-B, linkage structure(s) 611 may include linkage structures 611*a*-611*n* and strings 612 may include strings 612*a*-612*n*.

The muting unit 620 can provide one or more muting functions for the piano system 100. For example, the muting unit 620 can reduce the volume of sounds produced by the piano system 100 (e.g., sounds produced by generation unit 610). As another example, the muting unit 620 can mute one or more portions of the generation unit 610. More particularly, for example, the muting unit 620 can prevent generation of sounds by one or more strings of the generation unit 610. In some embodiments, the muting functions can be implemented by preventing interactions between one or more strings and their corresponding linkage structures (e.g., by preventing the strings from being impacted by the linkage structures).

In some embodiments, muting unit 620 may include one or more elastic structures 621, boards 622, and/or any other component for implementing muting functions. In some embodiments, each of the elastic structures 621 may include one or more springs, such as springs 631*a*-631*n* illustrated in FIG. 8-A. In some embodiments, each of the elastic structures 621 may include one or more elastic strips, such as elastic strips 641*a*-641*n* illustrated in FIG. 8-B. In some embodiments, the muting unit 620 may be operationally coupled to the switch 530. In some embodiments, when the switch 530 is switched to a particular working mode of the piano system 100, positioning information of one or more components of muting unit 620 (e.g., the location, direction, and/or orientation) may be adjusted to implement the working mode. In some embodiments, the muting unit 620 may be movable or detachable from the piano.

The elastic structure 621 may be elastic. The length, shape, and/or volume of the elastic structure 621 may be reduced or compressed when the elastic structure 621 is struck by the linkage structure 611. The elastic structure 621 may include one or more springs (e.g., springs 631*a*-631*n* as illustrated in FIG. 8-A), elastic strips (e.g., elastic strips 641*a*-641*n* as illustrated in FIG. 8-B), elastic buffers, etc. The springs may include a coil spring, a flat spring, a machined spring, a serpentine spring, a tension spring, a torsion spring, a coil spring, a flat spring, a serpentine spring, a helical spring, a leaf spring, a gas spring, a torsion spring, a wave spring, or the like, or a combination thereof. The elastic structure 621 may be made of any suitable material, such as, metal/alloy (e.g., steel, copper, aluminum, any alloy, etc.), polymers (e.g., rubbers, polybutadiene, nitrile rubber, etc.), composite materials (e.g., cork, metal-carbon fiber composite, composite ceramic and metal matrices, fiber-reinforced polymers, etc.), etc. The elastic structure 621 can have any suitable shape. For example, the elastic structure 621 may have a two-dimensional shape (e.g., triangular, square, rectangular, circular, etc.), a three-dimensional shape (e.g., hollow sphere, hollow cube, coiled tube, etc.), or the like.

The board 622 may be a housing in which the elastic structures 621 are mounted. The board 622 may be made of a variety of materials, such as, metals, plastics, wood, pottery, porcelain, ceramics, or the like, or any combination thereof. In some embodiments, the board may have an oblong shape with a substantially uniform thickness.

In some embodiments, the board 622 may be placed at various positions to implement various working modes of the piano system 100. For example, to implement the silent mode, the board 622 may be placed at a first position between the linkage structure(s) 611 and the string(s) 612 to prevent interactions between the linkage structure(s) 611 and the string(s) 612. More particularly, for example, the board at the first position may intercept the linkage structure(s) 611 before it strikes the string(s) 612. When a user depresses a key, the linkage structure(s) 611 may move towards the string(s) 612. The linkage structure(s) 611 may strike the elastic structure(s) 621 mounted on the board 622, generating a sound. The generated sound may be quieter than a sound generated when the linkage structure(s) 611 strikes the string(s) 612. After the interaction with the elastic structure(s) 621, the linkage structure(s) 611 may move backward to its resting position.

As another example, to implement a working mode other than the silent mode, the board 622 may be placed at a second position. In some embodiments, the second position is not located between the linkage structure(s) 611 and the string(s) 612. As such, string(s) 612 may be accessible by the linkage structure(s) 611. More particularly, for example, when a user depresses a key, the linkage structure(s) 611 may move towards the string(s) 612 and may interact with the string(s) 612 (e.g., by striking one or more strings 612). The string(s) 612 may then vibrate and generate a sound. After the interaction, the linkage structure may move backward to its resting position.

In some embodiments, the board 622 may be mechanically coupled with an action mechanism (not shown in the figures) that can cause the board to move between the positions and/or to be located at one or more of the positions. In some embodiments, the action mechanism may be and/or include a gear, an arm, a lock, or the like, or any combination thereof. In some embodiments, the action mechanism may be operationally coupled to the switch 530. When a working mode is selected using the switch 530, the switch 530 can cause the action mechanism to place the board 622 at one or more positions to implement the selected working mode.

Figure 7:
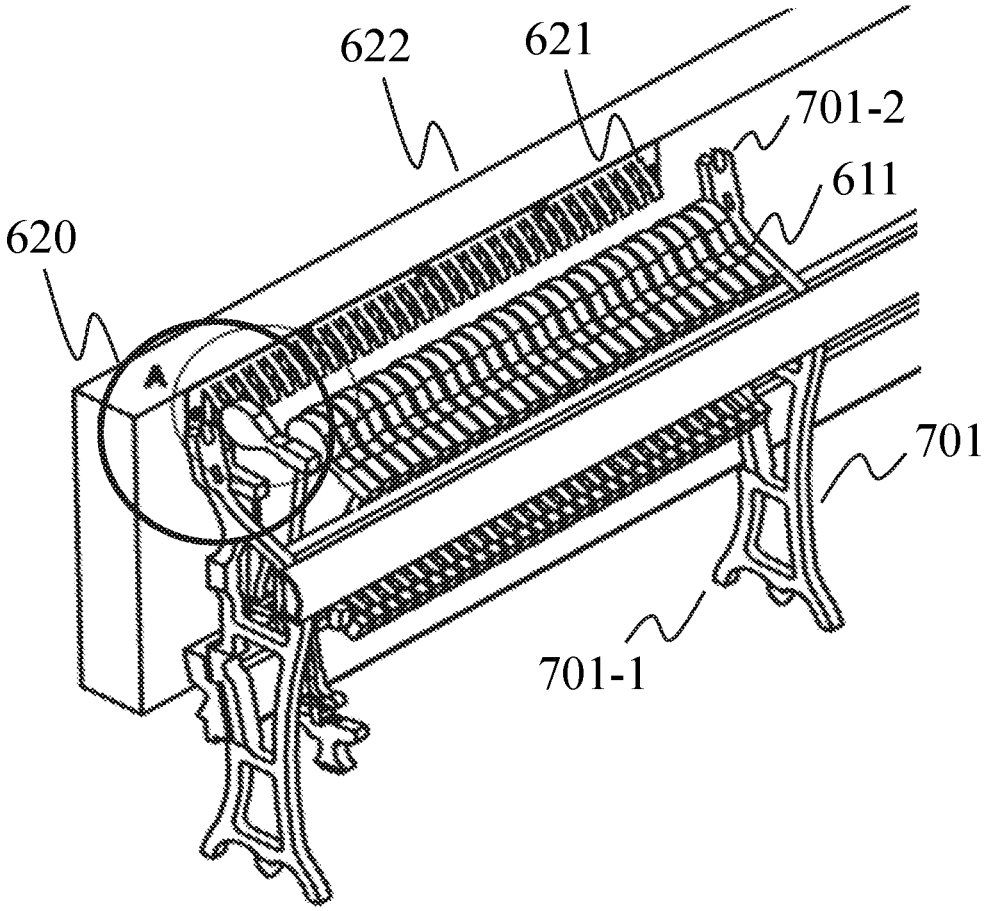
FIG. 7 is a diagram illustrating an exemplary acoustic component implementing the silent mode according to some embodiments of the present disclosure.

FIG. 7 is a diagram illustrating an exemplary acoustic component 540 implementing the silent mode according to some embodiments of the present disclosure. In some embodiments, to implement the silent mode, one or more components of muting unit 620 may be positioned between the strings 612 (not shown in FIG. 7) and linkage structures 611. For example, in the silent mode, the elastic structure 621 mounted on the board 622 may be positioned between the strings 612 and linkage structures 611. In some embodiments, the elastic structure 621 may be positioned close to the linkage structures 611 in a trajectory of linkage structures 611 moving towards the strings 612. Furthermore, one or more legs 701 may support the physical module 220 to keep balance. For example, the legs 701 may be positioned near two ends (e.g., the left end and the right end) of the physical module 220. In some embodiments, one end 701-1 of the leg 701 may be in contact with the ground. Another end 701-2 of the leg 701 may be fixed with the board 622 of the muting unit 620.

FIGS. 8-A and 8-B illustrate examples of acoustic component 540 and muting unit 620 implementing the silent mode according to some embodiments of the present disclosure.

As illustrated in FIG. 8-A, the elastic structures 621 may include one or more springs 631*a*-631*n* and one or more boards 622. To implement the silent mode, the muting unit 620 may be placed in a first position between linkage structures 611*a*-611*n* and strings 612*a*-612*n*. The springs 631*a*-631*n* may be included in the elastic structure 621. Multiple springs 631*a*-631*n* may or may not be connected with each other. The springs 631*a*-631*n* may or may not be evenly spaced. In some embodiments, one or more trestles 802 may support the board(s) 622. One or more linkage structures 611*a*-611*n* may correspond to one or more strings (612*a*-612*n*). For example, one linkage structure (e.g., 611*a*) may correspond to one string (e.g., 612*a*). In some embodiments, one linkage structure (e.g., 611*a*) may correspond to multiple strings (e.g., 612*a*-612*n*). In some embodiments, each of linkage structures 611*a*-611*n* may correspond to one or more springs 631*a*-631*n*. For example, a linkage structure (e.g., 611*a*) may be associated with one spring (e.g., 631*a*). In some embodiments, a linkage structure (e.g., 611*a*) may correspond to multiple springs (e.g., 631*a*-631*n*).

In some embodiments, each of springs 631*a*-631*n* may be compressed from its equilibrium length when struck by one or more linkage structures 611*a*-611*n*. The equilibrium length may refer to a length of the spring when the spring is free of external forces. As a result of the compression, the springs (e.g., 631*a*-631*n*) may exert a restoring force with a direction opposite to the compression. The restoring force may depend on the compression data relating to the springs (e.g., 631*a*-631*n*). For example, the restoring force may be determined based on the Hooke's Law. More particularly, for example, the restoring force may be linearly proportional to the length variation from the compressed length of a spring (e.g., 631*a*) to its equilibrium length. The ratio between the restoring force and the length variation may be referred to as a "force constant." In some embodiments, the force constant of the elastic structure 621 may be set by adjusting one or more features of the elastic structure 621 and/or the springs 631*a*-631*n*, such as the dimension, shape, structure, material, etc. of the elastic structure 621 and/or springs 631*a*-631*n*. In some embodiments, elastic structure 621 may include one or more elastic strips 641*a*-641*n* as illustrated in FIG. 8-B. The force constant may be set by adjusting the shape, dimension, and/or any other feature of the springs 631*a*-631*n* or elastic strips 641*a*-641*n*. For example, the elastic trips 641*a*-641*n* may be configured in a V-shaped formation. As another example, the springs 631*a*-631*n* may be in the shape of a coiled tube, generated by sweeping a circle about the path of a helix.

As shown in FIG. 8-B, the muting unit 620 may include one or more elastic structures 621, each of which may further include one or more elastic strips 641*a*-641*n*. The components of the piano system 100 may be arranged as described in FIG. 8-A. In some embodiments, the elastic strips 641*a*-641*n* may be positioned between the strings 612*a*-612*n* and the linkage structures 611*a*-611*n* in the silent mode. In some embodiments, the elastic strips 641*a*-641*n* may be straight or curved. The elastic strips may generate a restoring force when interacting with and/or compressed by the linkage structures 611*a*-611*n*, and the linkage structures 611*a*-611*n* may rebound as a result of the restoring force. In some embodiments, the silent mode may be implemented using one or more mechanisms described in connection with FIGS. 9-A and 9-B.

FIGS. 9-A and 9-B are diagrams illustrating mechanisms for implementing an exemplary acoustic component 540 in the silent mode according to some embodiments of the present disclosure.

As illustrated in FIG. 9-A, to implement the silent mode, the board 622 mounting the spring 621 may be positioned between the string 612 and the linkage structure 611. When the linkage structure 611 is at a resting position, the spring 621 may be separated from the linkage structure 611 by an initial distance of $L_1$. The string 612 may be parallel to the board 622 with a distance of $L_2$. One or more sensors (e.g., one or more sensors 310 of FIG. 3) may be configured to acquire information relating to one or more physical quantities, such as pressure, speed, acceleration, etc. In some embodiments, the sensor 310 may acquire pressure information on the linkage structure 611. In some embodiments, the pressure information may relate to a force applied to a first component by a second component. For example, the pressure information may include information about a pressure acted on an elastic structure 621 (e.g., springs 631*a*-631*n*, elastic strips 641*a*-641*n*, etc.) by a linkage structure. The sensors may be positioned and/or arranged in any suitable manner to detect the motion information. For example, one or more of the sensors 310 can be positioned on the tip of the linkage structure(s) 611. As another example, one or more of the sensors 310 may be positioned inside or on the surface of the elastic structure 621 (e.g., springs 631*a*-631*n*, elastic strips 641*a*-641*n*, etc.) or the board 622.

When a user 110 depresses a key in the keyboard 510, the pressure may be transmitted to a linkage structure 611. The linkage structure 611 may be then accelerated and start to move towards the elastic structure 621 on the board 622. The linkage structure may strike on the elastic structure 621 at a velocity of $V_h$. The striking impact may cause the linkage structure to decelerate, and the elastic structure 621 may be compressed. The compression may reach a maximum when the linkage structure 611 and elastic structure 621 stops moving. After the maximal compression, the elastic structure 621 may rebound and push the linkage structure 611. The linkage structure 611 may move backward to its original position.

As illustrated in FIG. 9-B, when the linkage structure 611 strikes on the elastic structure 621, the elastic structure 621 may be compressed along its axial direction. When the elastic structure 621 stops being compressed, its compression may reach a maximum. The distance between compressed elastic structure 621 and the linkage structure 611 may be $L_1'$, which may be greater than the length $L_1$. The difference between the two distances $L_1$ and $L_1'$ may be denoted as $\Delta L_1$, which may indicate the compressed length of the elastic structure 621 (e.g., the displacement of $\Delta L_1$). As the result of compression, the elastic structure 621 may exert a restoring force on the linkage structure 611. The restoring force may cause the linkage structure 611 to accelerate and move backward to its original position. The restoring force may be further transmitted to the key associated with the linkage structure 611 and cause the user 110 to feel the resilient linkage structure 611. The sensor 310 may acquire pressure data before, during, and/or after the impact. The acquired pressure data may be used by the processor 330 to generate one or more parameters relating to the impact in the silent mode.

In some embodiments, the restoring force of the elastic structure 621 may be calculated according to equation (1) shown below:

$$F_r = k \times \Delta L_1. \tag{1}$$

According to equation (1) (Hooke law), $F_r$ may refer to the restoring force, and $F_r$ may be proportional to a displacement $\Delta L_1$ and the force constant k of the elastic structure 621. The displacement $\Delta L_1$ may represent a distance by which the elastic structure 621 is extended or compressed by the restoring force $F_r$. For example, the displacement of $\Delta L_1$ may be a difference between the compressed length of an elastic structure 621 and its equilibrium length.

The length variation may depend on the velocity $V_h$ of the linkage structure 611. In some embodiments, the displacement $\Delta L_1$ may be calculated according to equation (2):

$$\Delta L_1 = V_h\left(\frac{M_h}{k}\right)^{1/2}. \tag{2}$$

Here, $M_h$ may refer to the mass of the linkage structure 611.

Based on equations (1) and (2), the restoring force $F_r$ may be calculated as:

$$F_r = kV_h\left(\frac{M_h}{k}\right)^{1/2} = V_h(kM_h)^{1/2}. \tag{3}$$

According to equation (3), the restoring force may depend on the velocity of the linkage structure 611 and the force constant of the elastic structure 621. An elastic structure 621 having a greater force constant k may exert a greater restoring force. A greater restoring force may cause the user 110 to feel stronger rebound when releasing the key.

In some embodiments, the distance $L_1$ between the elastic structure 621 and the linkage structure 611 may be set or adjusted according to the force constant of the elastic structure 621. In some embodiments, the distance between the board 622 and the linkage structure 611 may be set or adjusted according to the force constant of the elastic structure 621.

Figure 10:
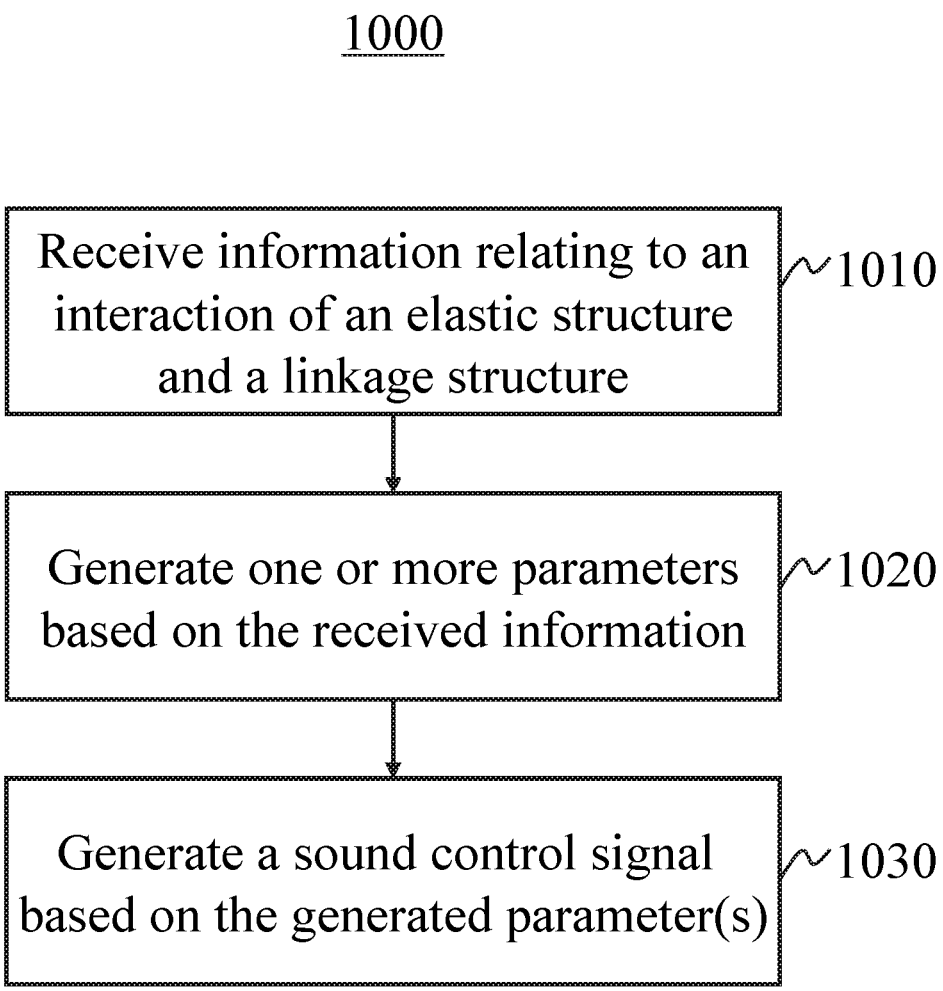
FIG. 10 is a flowchart of an exemplary process for implementing a silent mode for a piano system according to some embodiments of the present disclosure.

FIG. 10 is a flowchart of an exemplary process 1000 for implementing a silent mode for a piano system (e.g., the piano system 100) according to some embodiments of the present disclosure.

In step 1010, a processor (e.g., the processor 330 of FIG. 3) may receive information relating to an interaction between an elastic structure (e.g., the elastic structure 621 of FIG. 7, the springs 631*a*-631*n* of FIG. 8-A, the elastic strips 641*a*-641*n* of FIG. 8-B) and a linkage structure (e.g., the linkage structure 611 of FIG. 7, the linkage structures 611*a*-611*n* of FIGS. 8-A and 8-B). The interaction may include contact with one or more portions of the elastic structure by the linkage structure. For example, when a key of the piano system is depressed, a linkage structure associated with the depressed key may move towards the elastic structure. The linkage structure may strike on the elastic structure. The linkage structure may stay in contact with the elastic structure for any time period. In some embodiments, the information may include pressure on the linkage structure, pressure on the elastic structure, a speed of the linkage structure, an acceleration of the linkage structure, the compression of the elastic structure, etc. In some embodiments, the information may be acquired by one or more sensor(s) 310.

In some embodiments, the processor 330 may pre-process the received information. The pre-processing may include de-noising, smoothing, filtering, clipping, transformation of units, etc. The pre-processing may enhance the reliability or usability of the received information.

In step 1020, the processor 330 may generate one or more parameters based on the information received in step 1010. The parameter(s) may relate to the pressure, speed, acceleration of the linkage structure 611, etc. The parameter(s) may include, for example, the maximal value of the pressure, the minimal value of the pressure, the variation of the pressure over time, the duration of the pressure, the total impulse of the pressure during a certain period, etc. In some embodiments, the processor 330 may process the information according to one or more functions, data sheets, etc. that describe the relationship between the parameter(s) and the received information.

In step 1030, the processor 330 may generate a sound control signal based on the parameter(s) generated in step 1020. The sound control signal may include one or more characteristics of an electronic sound. The characteristics may include a frequency, a frequency spectrum, a duration, an amplitude, a volume, a pitch, etc. In some embodiments, the parameters relating to the pressure data may be translated into a sound control signal using a certain algorithm. The translation may include, without limitation, Fourier transformation, Laplacian transformation, wavelet transformation, modulation (e.g., pulse code modulation or PCM), waveform processing, or the like, or a combination thereof. In some embodiments, the sound control signal may be used by a sound-generating device, such as an audio player, a loudspeaker, an earphone, or a microphone, to produce a sound. For example, the peripheral device 120 (e.g., an audio player) may convert the sound control signal into audio content based on one or more algorithms, according to the audio format. As another example, the peripheral device 120 (e.g., a loudspeaker, a headset, etc.) may convert the audio content into sounds. In some embodiments, the sound control signal may be encoded, encrypted, or compressed. In some embodiments, the sound control signal may be stored in storage 340 after its generation.

In some embodiments, the piano system 100 may output the sound control signal to a peripheral device (e.g., the peripheral device 120). The peripheral device may convert the sound control signal to an electronic sound. In some embodiments, the electronic sound may be played according to the sound control signal by the periphery device (e.g., an audio player, a headset, a loudspeaker, etc.).

Figure 11:
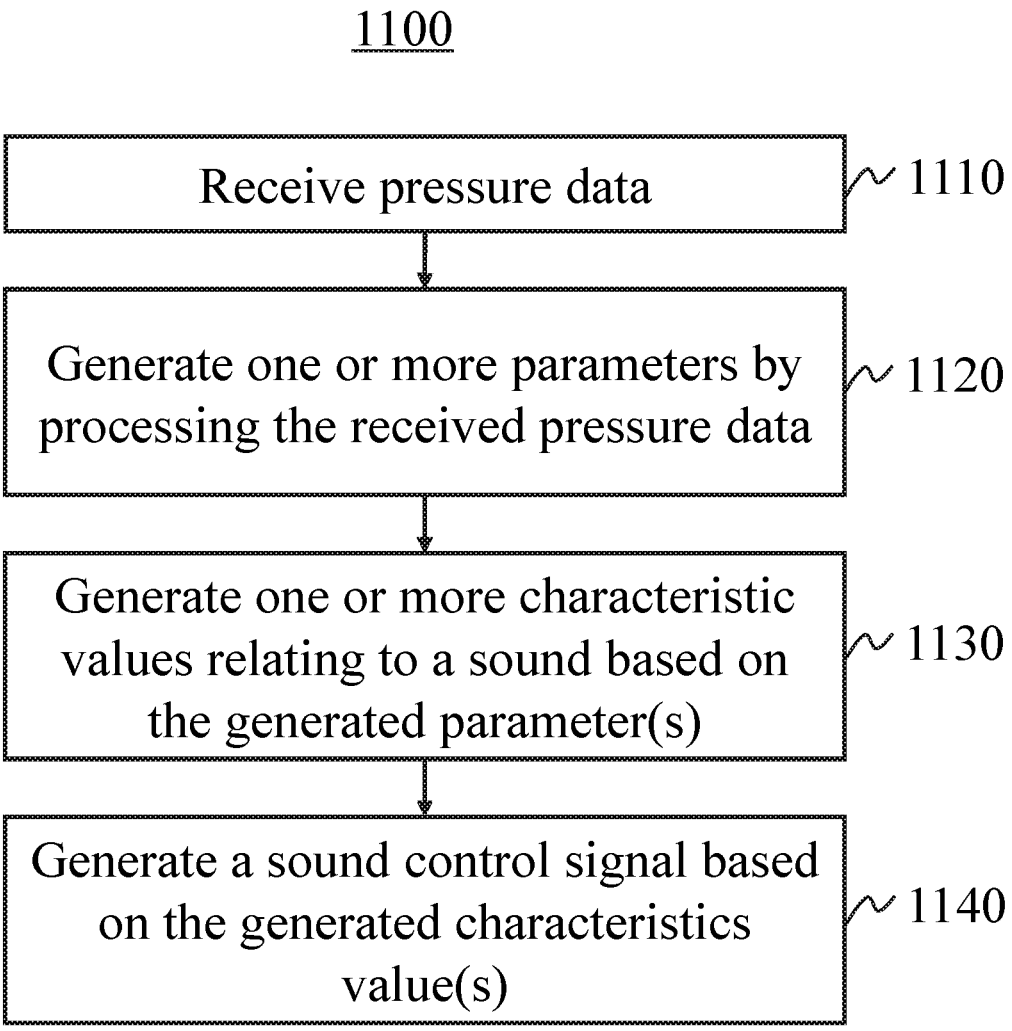
FIG. 11 is a flowchart of an exemplary process for providing audio content for a piano system according to some embodiments of the present disclosure.

FIG. 11 is a flowchart of an exemplary process 1100 for providing audio content for a piano system (e.g., the piano system 100) according to some embodiments of the present disclosure.

In step 1110, the processor 330 may receive pressure data. The pressure data may include one or more values of the pressure on a component of the piano system 100. The component may be and/or include a key, a linkage structure 611, a string 612, etc. In some embodiments, the processor 330 may obtain the pressure information from the sensor 310 in a real-time manner, periodically, or from the storage 340 via the I/O interface 320.

In step 1120, the processor 330 may generate one or more parameters by processing the pressure data received in step 1110. The parameter(s) may relate to the pressure data. The parameter(s) may be and/or include a value of the pressure, a derivative of the pressure, a gradient of the pressure, a frequency of the pressure variation, etc. The value of the pressure may be and/or include a maximal value, a minimal value, an average value, a median value, etc. The derivative of the pressure may be and/or include a time derivative, which may be a derivative of the pressure with respect to time. The gradient of the pressure may be and/or include a gradient along a spatial direction. In some embodiments, the parameter(s) may be generated based on a certain algorithm. The algorithm may include addition, subtraction, multiplication, division, exponentiation, logarithm, derivation, integration, differentiation, Fourier transformation, Laplace transformation, wavelet transformation, linear regression, fitting, smoothing, or the like, or a combination thereof.

In step 1130, the processor 330 may generate one or more characteristic values relating to a sound based on the parameter(s) generated in step 1120. The characteristic value(s) may be and/or include one or more sound frequencies (i.e., music tone), duration of sound, amplitude (i.e., sound volume), a pitch of the sound, etc. The generation of characteristic value(s) may be in accord with one or more certain mapping rules. In some embodiments, the mapping rule(s) may be determined based on the relationship between characteristic value(s) and parameter(s). In some embodiments, the relationship may be expressed as one or more functions, data sheets, etc. In some embodiments, the parameter(s) may be converted to characteristic value(s) based on the relationship. For example, the sound frequency may be determined based on the frequency of the pressure variation. As another example, the duration of sound may be determined based on the duration of pressure. As still another example, the sound volume may be determined based on the total impulse of the pressure, etc.

In step 1140, the processor 330 may generate a sound control signal based on the characteristic values generated in step 1130. The sound control signal may be a frequency waveform, a time-domain audio spectrum, an electricity waveform, a digital translation information, a pulse code modulation (PCM) of the sound, etc. The generation of the sound control signal may be based on a certain transition rule. In some embodiments, the transition rule may be determined based on the relationship between the sound control signal and the characteristic values. In some embodiments, a specific music tone may correspond to a waveform with a specific frequency, a sound volume may correspond to the amplitude of a waveform. In some embodiments, the sound frequency (and/or sound volume, etc.) may be extracted from the characteristic values, and corresponding waveform(s) may be synthesized. In some embodiments, the sound control signal may be expressed by one or more audio formats, for example, waveform audio file format (WAV), audio interchange file format (AIFF), adaptive transform acoustic coding (ATRAC), MP3, etc. In some embodiments, the sound control signal may be encoded, encrypted, or compressed. In some embodiments, the sound control signal may be stored in storage 340 after its generation. In some embodiments, the sound control signal may be used by the peripheral device 120, such as an audio player, a loudspeaker or a headset, to play a sound/music. For example, the peripheral device 120 (e.g., an audio player) may convert the sound control signal into audio content based on one or more algorithms, according to the audio format. As another example, the peripheral device 120 (e.g., a loudspeaker, a headset, etc.) may convert the audio content into sounds.

The above description may serve for an illustrative purpose, it is not intended that it should be limited to any particulars or embodiments. The scope of the disclosure herein is not to be determined from the detailed description, but rather from the claims as interpreted according to the full breadth permitted by the patent laws. It is to be understood that the embodiments shown and described herein are only illustrative of the principles of the present disclosure and that various modifications may be implemented by those skilled in the art without departing from the scope and spirit of the disclosure. Those skilled in the art could implement various other feature combinations without departing from the scope and spirit of the disclosure.

The various methods and techniques described above provide a number of ways to carry out the application. Of course, it is to be understood that not necessarily all objectives or advantages described can be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some preferred embodiments specifically include one, another, or several features, while others specifically exclude one, another, or several features, while still others mitigate a particular feature by inclusion of one, another, or several advantageous features.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Preferred embodiments of this application are described herein. Variations on those preferred embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

What is claimed is:

1. A piano system, comprising:

a plurality of linkage structures coupled to a plurality of keys;

a plurality of strings corresponding to the plurality of linkage structures; and a muting unit configured to place at least one elastic structure at a first position to implement a first mode for the piano system, wherein the first position is located between the linkage structures and the strings, the at least one elastic structure is placed at the first position to be struck by a block head of at least one of the linkage structures, and prevent an interaction between the block head of the at least one of the linkage structures and the strings when one of the plurality of keys is depressed.

2. The piano system of claim 1, further comprising a switch configured to switch between the first mode and a second mode.

3. The piano system of claim 2, wherein the muting unit is configured to place the at least one elastic structure at a second position for implementing the second mode, wherein the second position is not located between the linkage structures and the strings.

4. The piano system of claim 2, wherein the milting unit further comprises a board configured to mount a plurality of elastic structures.

5. The piano system of claim 4, wherein the muting unit is further configured to:

place the board at the first position to implement the first mode; and place the board at the second position to implement the second mode.

6. The piano system of claim 5, wherein the board is operationally coupled to an action mechanism for moving between the first position and the second position.

7. The piano system of claim 2, wherein the piano system provides at least one muting function in the first mode.

8. The piano system of claim 2, wherein the plurality of linkage structures corresponds to the plurality of strings to generate a sound in the second mode.

9. The piano system of claim 1, wherein the at least one elastic structure comprises at least one of a spring, an elastic strip, or an elastic buffer.

10. The piano system of claim 1, further comprising a plurality of sensors configured to record information relating to a first interaction between at least one of the linkage structures and the at least one elastic structure in the first mode.

11. The piano system of claim 10, wherein the information comprises at least one of pressure information, motion information, or compression information.

12. The piano system of claim 10, wherein the sensors comprise at least one of a pressure sensor, a speed sensor, an accelerometer, or a mechanical sensor.

13. The piano system of claim 10, further comprising a processor configured to:

generate a plurality of parameters based on the information;

generate a plurality of characteristic values of a sound based on the plurality of parameters; and generate a sound control signal based on the plurality of characteristic values.

14. The piano system of claim 13, further comprising a peripheral device configured to:

generate a sound based on the sound control signal.

15. The piano system of claim 1, wherein a first sound is generated when the at least one elastic structure is struck by the block head of the at least one of the linkage structures; and the first sound is quieter than a second sound generated when the block head of the at least one of the linkage structures strikes at least one of the strings.

16. A method implemented on at least one device, each of the at least one device having at least one processor and a storage, the method comprising:

switching a piano system to a first mode; and providing, using a muting unit, at least one muting function to implement the first mode, comprising:

placing an elastic structure at a first position to be struck by a block head of a linkage structure, and prevent an interaction between the block head of the linkage structure and a string of the piano system when a key of the piano system is depressed, wherein the first position is located between the linkage structure and the string.

17. The method of claim 16, further comprising:

switching the piano system to a second mode; and placing the elastic structure at a second position to implement the second mode, wherein the second position is not located between the linkage structure and the string.

18. The method of claim 16, wherein providing the at least one muting function further comprises placing a board mounting the elastic structure at the first position.

19. The method of claim 16, further comprising:

recording information relating to a first interaction between the linkage structure and the elastic structure in the first mode;

generating a plurality of parameters based on the information;

generating a plurality of characteristic values of a sound based on the plurality of parameters; and generating a sound control signal based on the plurality of characteristic values.

20. The method of claim 19, further comprising:

generating, in a peripheral device of the piano system, a sound based on the sound control signal.

* * * * *